US011740580B2

(12) United States Patent
Ishikawa et al.

(10) Patent No.: US 11,740,580 B2
(45) Date of Patent: Aug. 29, 2023

(54) IMAGE FORMING SYSTEM AND METHOD FOR DETECTING GLOSSINESS

(71) Applicant: KONICA MINOLTA, INC., Tokyo (JP)

(72) Inventors: Akimasa Ishikawa, Toyokawa (JP); Hitoshi Asano, Toyokawa (JP); Yumiko Izumiya, Hachioji (JP); Hirotada Seki, Toyokawa (JP); Kazutoshi Yoshimura, Hino (JP); Yasuo Koyanagi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/743,577

(22) Filed: May 13, 2022

(65) Prior Publication Data

US 2022/0390889 A1 Dec. 8, 2022

(30) Foreign Application Priority Data

Jun. 8, 2021 (JP) ..... 2021-096039

(51) Int. Cl.
*G03G 15/20* (2006.01)
*G03G 15/00* (2006.01)

(52) U.S. Cl.
CPC ..... *G03G 15/6585* (2013.01); *G03G 15/5029* (2013.01); *G03G 15/5062* (2013.01)

(58) Field of Classification Search
CPC ..... G03G 15/5029; G03G 15/6585; G03G 15/6588; G03G 15/6591; G03G 15/5062; G03G 2215/00805
See application file for complete search history.

(56) References Cited

U.S. PATENT DOCUMENTS

| | | | | |
|---|---|---|---|---|
| 10,663,902 | B2 * | 5/2020 | Horiguchi | G03G 15/2021 |
| 2015/0070737 | A1 | 3/2015 | Hirata et al. | |
| 2021/0325810 | A1 * | 10/2021 | Ishikawa | G03G 15/5062 |
| 2022/0011703 | A1 | 1/2022 | Takahashi et al. | |

FOREIGN PATENT DOCUMENTS

JP 2015078975 A 4/2015

OTHER PUBLICATIONS

U.S. Appl. No. 17/529,414, First Named Inventor: Atsushi Takahashi; Title: "Image Forming Apparatus"; filed Nov. 18, 2021.

* cited by examiner

*Primary Examiner* — Hoang X Ngo
(74) *Attorney, Agent, or Firm* — Holtz, Holtz & Volek PC

(57) ABSTRACT

Provided are an image forming system and a method for detecting glossiness capable of accurately detecting glossiness in various media having different conditions.
The image forming system includes a sensor unit including a light source that irradiates a medium being conveyed with light and a gloss sensor that receives light emitted from the light source and specularly reflected on the medium and detects a diffusion distribution of light in the medium, and a detection condition setting unit that identifies a type of the medium being conveyed and sets a light amount of the light source and/or exposure time of the gloss sensor at the time of glossiness detection in accordance with the type of the medium. The image forming system further includes a glossiness detector that detects glossiness of the medium from a diffusion distribution of light detected by the gloss sensor under the detection condition set by the detection condition setting unit.

12 Claims, 12 Drawing Sheets

FIG. 10

| DETECTED BY FIRST GLOSS SENSOR | DETECTED BY IMAGE SENSOR | | | | |
|---|---|---|---|---|---|
| PAPER TYPE | COLOR | BW RATIO | TONER ADHESION AMOUNT | EXPOSURE TIME OF SECOND GLOSS SENSOR [ms] | LIGHT EMISSION AMOUNT OF SECOND LIGHT SOURCE / LED CURRENT [mA] |
| PLAIN PAPER | K | 100% | REGULAR | 20ms | 100mA |
| COATED PAPER | K | 100% | REGULAR | 10ms | 50mA |
| COATED PAPER | Y | 100% | REGULAR | 5ms | 25mA |
| COATED PAPER | K | 50% | REGULAR | 2ms | 10mA |
| COATED PAPER | K | 100% | LOW | 2ms | 10mA |
| COATED PAPER | K | 100% | HIGH | 7ms | 35mA |

IMAGE FORMING SYSTEM AND METHOD FOR DETECTING GLOSSINESS

CROSS-REFERENCE TO RELATED APPLICATIONS

The entire disclosure of Japanese patent Application No. 2021-96039, filed on Jun. 8, 2021, is incorporated herein by reference in its entirety.

BACKGROUND

Technological Field

The present invention relates to an image forming system and a method for detecting glossiness.

Description of the Related Art

In the related art, there has been proposed a configuration in which a sensor for detecting gloss of a medium is provided in a sheet feeding path or a conveyance path of the medium (recording medium) in an image forming apparatus. The sensor for detecting gloss includes, for example, light receiving elements (linear sensors) arranged one-dimensionally, and detects the gloss of the medium by detecting a light amount distribution of specular light in the light receiving elements.

Patent Literature 1 discloses a method for detecting glossiness in a glossiness determination device by gradually increasing a light emission amount of a light source from a reference value to an amount by which a saturated image is output.

RELATED ART LITERATURE

Patent Literature
Patent Literature 1: JP 2015-78975 A

SUMMARY

By the way, when exposure time in the linear sensor is made constant, the exposure time is generally set such that the image acquired by the linear sensor is not saturated with reference to the reflected light detected from the high-gloss medium. In such a setting, when specular light reflected from a low-gloss medium is received, the output of the linear sensor becomes low, and there is a possibility that gloss cannot be accurately detected due to noise or the like.

As such, an object of the present invention is to provide an image forming system and a method for detecting glossiness capable of accurately detecting glossiness in various media having different conditions.

In order to solve the above problems and achieve the object of the present invention, an image forming system according to the present invention includes a sensor unit including a light source that irradiates a medium being conveyed with light, and a gloss sensor that receives light emitted from the light source and specularly reflected on the medium, and detects a diffusion distribution of light in the medium. The image forming system further includes a detection condition setting unit that identifies a type of the medium to being conveyed and sets a light amount of the light source and/or exposure time of the gloss sensor at time of glossiness detection in accordance with the type of the medium, and a glossiness detector that detects glossiness of the medium from the diffusion distribution of light detected by the gloss sensor under a detection condition set by the detection condition setting unit.

A method for detecting glossiness according to the present invention uses a sensor unit including a light source that irradiates a medium being conveyed with light, and a gloss sensor that receives light emitted from the light source and specularly reflected on the medium and detects a diffusion distribution of light in the medium. First, a type of the medium being conveyed is identified, and a light amount of the light source and/or exposure time of the gloss sensor at the time of glossiness detection are/is set in accordance with the type of the medium. Then, a diffusion distribution of light in the medium is detected by the gloss sensor by using the set light amount of the light source and/or the set exposure time of the gloss sensor. Thereafter, glossiness of the medium is detected from the detected diffusion distribution of light.

According to an embodiment of the present invention, glossiness in various media under different conditions can be accurately detected.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 10 is an example of a table indicating glossiness detection conditions in accordance with a paper type and image information;

DETAILED DESCRIPTION OF EMBODIMENTS

Figure 1:
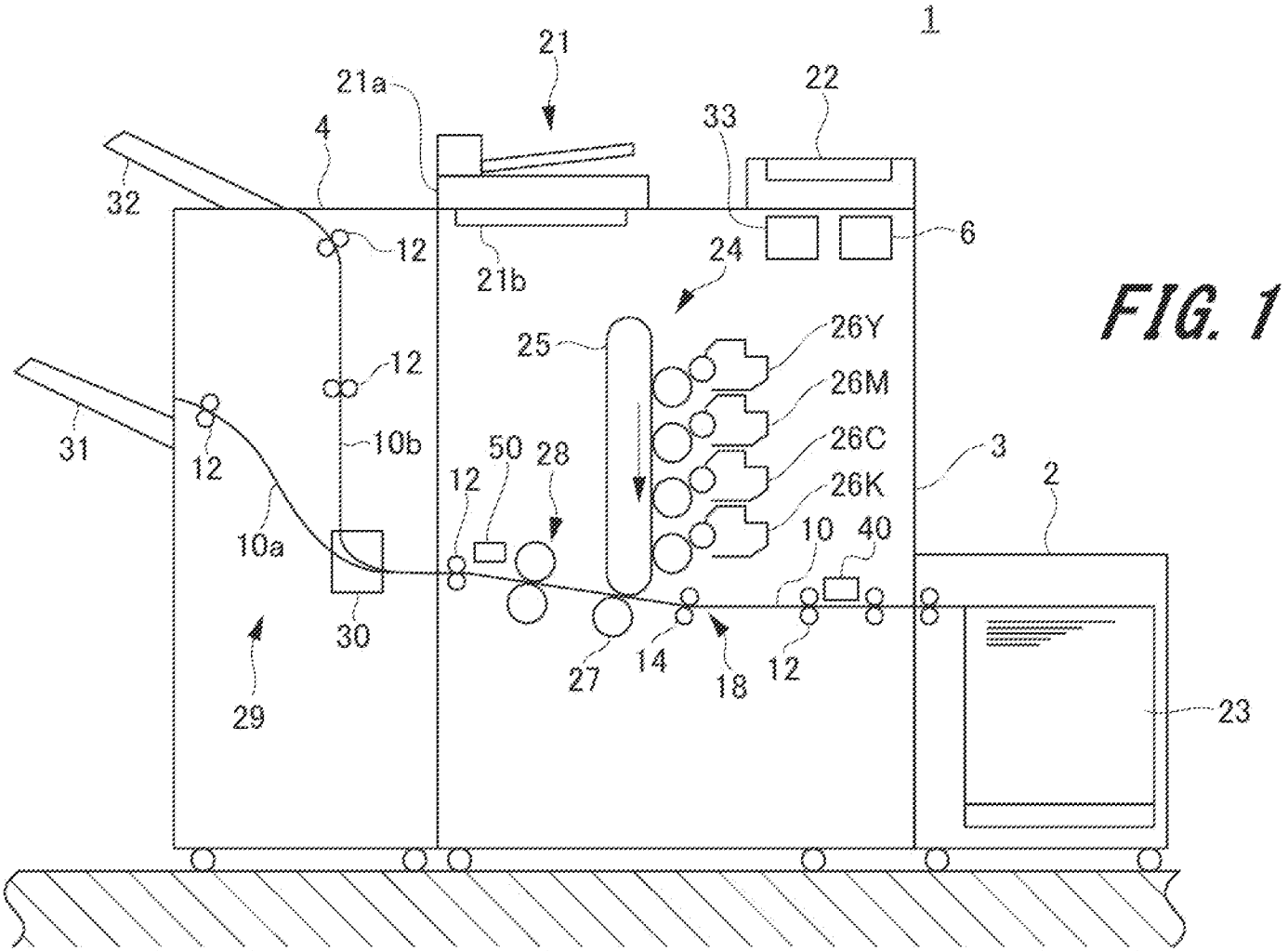
FIG. 1 is an overall configuration diagram of an image forming system according to an embodiment of the present invention.

Hereinafter, one or more embodiments of the present invention will be described with reference to the drawings. However, the scope of the invention is not limited to the disclosed embodiments.

Hereinafter, an example of an image forming system and a method for detecting glossiness according to embodiments of the present invention will be described with reference to the drawings. Note that the present invention is not limited to the following examples. In the drawings described below, common members are denoted by the same reference numerals.

1. Configuration of Image Forming System

FIG. 1 is an overall configuration diagram of an image forming system 1 according to an embodiment of the present invention (hereinafter, referred to as the "present embodiment"). As illustrated in FIG. 1, the image forming system 1 according to the present embodiment includes a sheet feeding unit 2, an image forming apparatus 3, and a sheet ejection unit 4.

[Sheet Feeding Unit]

The sheet feeding unit 2 includes a sheet feeding tray 23. A large amount of sheet (one of the recording materials; also referred to as a "medium") can be stored in the sheet feeding tray 23. In the sheet feeding unit 2, a sheet is fed from the sheet feeding tray 23 to the image forming apparatus 3 side on the basis of the instruction content of the job. The feeding of the sheet from the sheet feeding tray 23 is performed by driving a sheet feeding roller (not illustrated) provided corresponding to the sheet feeding tray 23. The sheet fed from the sheet feeding tray 23 is then conveyed to the image forming apparatus 3 side along a sheet conveyance path 10 of a sheet conveyor 18.

The sheet conveyor 18 includes the sheet conveyance path 10 and a plurality of conveyance rollers 12. The sheet conveyance path 10 is provided from the sheet feeding unit 2 to the sheet ejection unit 4 via the image forming apparatus 3. In the sheet conveyor 18, the sheet is conveyed by the plurality of conveyance rollers 12 on the basis of an instruction of a controller 6 to be described later.

[Image Forming Apparatus]

The image forming apparatus 3 is an electrophotographic image forming apparatus, and is a tandem-type color image forming apparatus capable of forming a full-color image by superimposing toner images of respective colors of yellow (Y), magenta (M), cyan (C), and black (K).

The image forming apparatus 3 includes an image reader 21, an operation display 22, an image processor 33, an image former 24, an intermediate transfer belt 25, a secondary transfer roller 27, a fixing unit 28, and the controller 6. The image forming apparatus 3 includes a first sensor unit 40 and a second sensor unit 50.

The image reader 21 reads an image of a document. The image reader 21 includes an automatic document feeder (ADF) 21*a* and a document image scanner 21*b*. The automatic document feeder 21*a* conveys a document placed on a document tray by a conveying mechanism and feeds the document to the document image scanner 21*b*. The image reader 21 can continuously read images of a large number of documents placed on the document tray by cooperating with the automatic document feeder 21*a* and the document image scanner 21*b*. The document image scanner 21*b* optically scans a document conveyed onto a contact glass by the automatic document feeder 21*a* or a document placed on the contact glass by a user, and reads an image of the document by forming an image of reflected light from the document on a light receiving surface of a charge coupled device (CCD) sensor or the like. The image reader 21 generates image data on the basis of a reading result by the document image scanner 21*b*.

The operation display 22 has a function as an operation unit that receives input operation by the user and a function as a display that displays various types of information to the user. The operation display 22 includes, for example, a touch panel type liquid crystal display, and can receive operation by the user and display information to the user. The operation unit may include a mouse, a tablet, or the like, and the operation unit may be configured separately from the display.

The image processor 33 performs predetermined image processing on the image data read by the image reader 21 or the image data received via a communicator 70 (see FIG. 2). Examples of the predetermined image processing include gradation correction and halftoning. The gradation correction is processing of correcting the gray level of each pixel of the image data such that the density of the image formed on the sheet coincides with the target density. Examples of halftoning include error diffusion processing and screen processing using an ordered dithering method.

The image former 24 includes four image forming units 26Y, 26M, 26C, and 26K to form toner images of respective colors of yellow (Y), magenta (M), cyan (C), and black (K). Each of the four image forming units 26Y, 26M, 26C, and 26K includes a photosensitive drum, a charger, an exposure unit, a developing unit, a static eliminator, a drum cleaner, and the like. The image former 24 controls the operation of each of the image forming units 26Y, 26M, 26C, and 26K to form toner images of the respective colors.

The image former 24 forms a toner image on the surface of the photosensitive drum included in each of the image forming units 26Y, 26M, 26C, and 26K. The toner image is formed by following the process described below. First, the surface of the photosensitive drum is charged by the charger. Next, the surface of the charged photosensitive drum is exposed by the exposure unit to erase charges, thereby forming an electrostatic latent image on the surface of the photosensitive drum. Next, the surface of the photosensitive drum is supplied with toner by the developing unit, thereby developing the electrostatic latent image by adhesion of toner. By the above process, a toner image is formed on the surface of the photosensitive drum. At this time, a yellow toner image is formed on the photosensitive drum of the image forming unit 26Y, and a magenta toner image is formed on the photosensitive drum of the image forming unit 26M. Further, a cyan toner image is formed on the photosensitive drum of the image forming unit 26C, and a black toner image is formed on the photosensitive drum of the image forming unit 26K.

The intermediate transfer belt 25 includes a rotating endless belt. In the intermediate transfer belt 25, the toner images of the respective colors formed on the surfaces of the photosensitive drums included in the image forming units 26Y, 26M, 26C, and 26K are sequentially transferred to the surface of the intermediate transfer belt 25. The transfer of the toner image from the photosensitive drum to the intermediate transfer belt 25 is performed by a primary transfer roller (not illustrated). At this time, the toner images of the respective colors are transferred to the intermediate transfer belt 25 in a superimposing manner. This stage of transfer is referred to as primary transfer. As a result, a color toner image is formed on the intermediate transfer belt 25.

The secondary transfer roller 27 (transfer unit of the present invention) collectively transfers the color toner image formed on the intermediate transfer belt 25 to the conveyed sheet. This stage of transfer is referred to as secondary transfer. At the time of secondary transfer, the sheet is fed from a registration unit 14 provided in the sheet conveyance path 10 to the secondary transfer roller 27 in accordance with the timing at which the toner image arrives at the secondary transfer roller 27.

The registration unit 14 includes, for example, a pair of registration rollers. The pair of registration rollers is disposed in contact with each other at a predetermined pressure. In the registration unit 14, the sheet being conveyed by the sheet conveyance path 10 abuts on the contact portion between the pair of registration rollers. In this way, skew of the sheet is corrected, and conveyance of the sheet is temporarily stopped. The pair of registration rollers rotates while nipping the sheet to feed the sheet toward the secondary transfer roller 27, and swings in a direction orthogonal to the sheet conveyance direction in the middle of this feeding. In this way, misalignment of the sheet in the width direction is corrected.

Then, the sheet is fed from the registration unit 14 to the secondary transfer roller 27 at the timing when the toner image arrives at the secondary transfer roller 27, whereby the color toner image on the intermediate transfer belt 25 is secondarily transferred to the sheet. As a result, a color toner image is formed on the sheet. Thereafter, the sheet is conveyed to the fixing unit 28.

The fixing unit 28 includes a pair of rollers including a fixing roller and a pressure roller. A heater is built in the fixing roller, and the fixing roller and the pressure roller are disposed in a state of being pressed against each other. In the fixing unit 28, the sheet conveyed via the secondary transfer roller 27 is nipped by a pair of rollers and pressurized and heated, whereby the toner on the sheet is heated and melted and the melted toner is pressure-bonded to the sheet. In this way, the toner image can be fixed on the sheet. In the fixing unit 28, the sheet subjected to the fixing processing is conveyed to the image inspection unit.

Figure 2A:
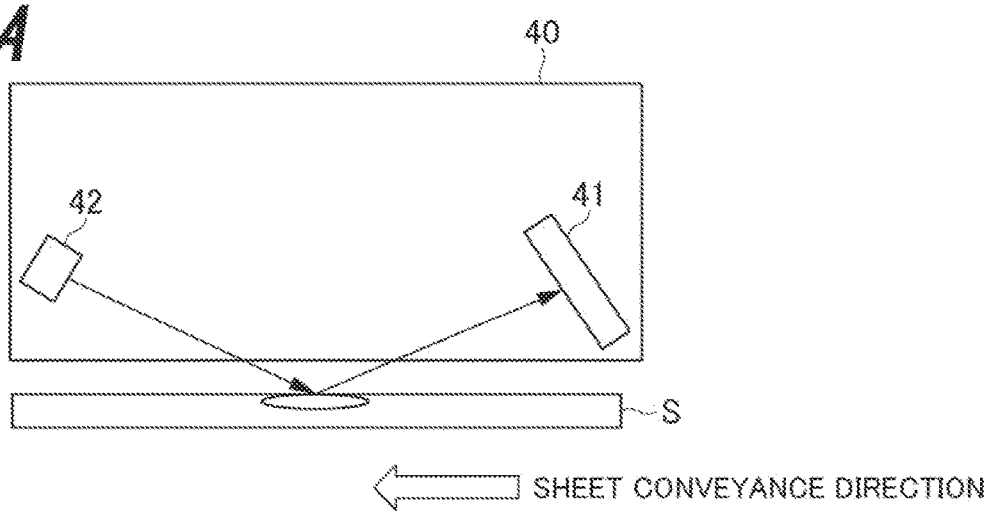
FIG. 2A is a schematic configuration diagram of a first sensor unit.

The first sensor unit 40 is installed above the sheet conveyance path 10 of a sheet fed from the sheet feeding unit 2 to the image forming apparatus 3 side, and is disposed on the upstream side of the secondary transfer roller 27 in the sheet conveyance direction. FIG. 2A is a schematic configuration diagram of the first sensor unit 40 according to the present embodiment. As illustrated in FIG. 2A, the first sensor unit 40 includes a first light source 42 and a first gloss sensor 41. The first light source 42 and the first gloss sensor 41 are each disposed at a position away from the sheet conveyance path 10 by a predetermined distance above the sheet conveyance path 10 in the vertical direction, and the first gloss sensor 41 and the first light source 42 are disposed in this order from the upstream side in the direction along the sheet conveyance direction.

The first light source 42 includes, for example, a light emitting diode (LED), a laser oscillator, or the like, and is configured to irradiate a sheet being conveyed with white light or ultraviolet light. In the present embodiment, the first light source 42 is disposed such that the incident angle of the irradiation light with respect to the surface of a sheet S is a predetermined angle (60 degrees in the present embodiment). In the present embodiment, since the specular light is detected by the first gloss sensor 41, light emitted from the first light source 42 preferably has a certain degree of directivity.

The first gloss sensor 41 includes a linear sensor. In the linear sensor, light receiving elements such as charge-coupled devices (CCDs) or complementary metal oxide semiconductors (CMOSs) are one-dimensionally arranged in a direction along the conveyance direction of the sheet S. The first gloss sensor 41 acquires specular light emitted from the first light source 42 and reflected on the surface of the sheet S. In the present embodiment, the light amount of the first light source 42 in the first sensor unit 40 and the exposure time in the first gloss sensor 41 are constant.

In the present embodiment, the first gloss sensor 41 outputs a signal corresponding to the light amount of light reflected by the sheet S. In this way, the first gloss sensor 41 acquires the diffusion distribution of light reflected by the sheet S. In the present embodiment, a detection condition setting unit 60 to be described later (see FIG. 3) identifies the paper type (medium type) of the sheet S on the basis of the information of the diffusion distribution of light detected by the first gloss sensor 41.

Figure 2B:
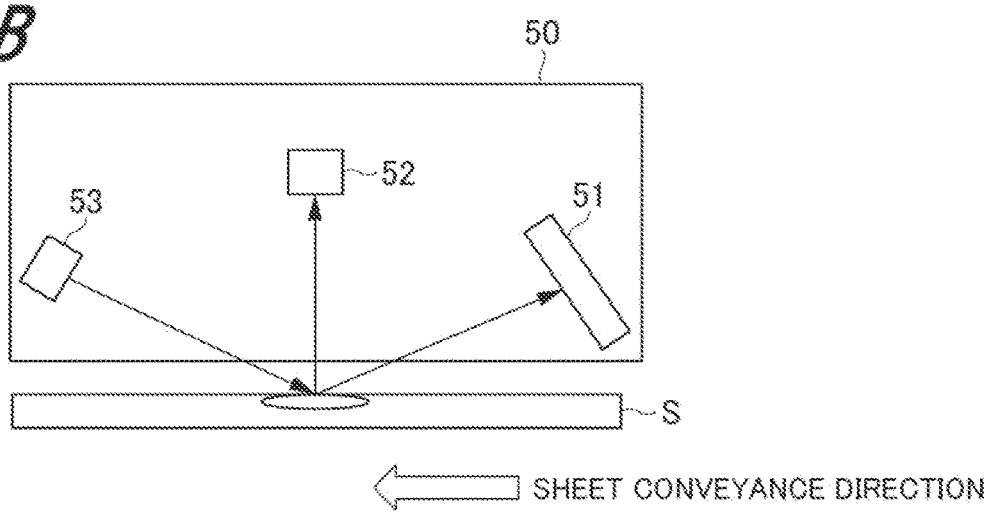
FIG. 2B is a schematic configuration diagram of a second sensor unit.

As illustrated in FIG. 1, the second sensor unit 50 is disposed on the downstream side of the fixing unit 28 in the sheet conveyance direction, and is installed above the sheet conveyance path of the sheet to be fed to the sheet ejection unit 4 side. FIG. 2B is a schematic configuration diagram of the second sensor unit 50 according to the present embodiment. As illustrated in FIG. 2B, the second sensor unit 50 includes a second light source 53, a second gloss sensor 51, and an image sensor 52. The second sensor unit 50 is disposed on the upper side in the vertical direction of the sheet conveyance path 10, which is the image forming surface side of the sheet ejected from the fixing unit 28. The second light source 53, the image sensor 52, and the second gloss sensor 51 are each disposed at a position away from the sheet conveyance path 10 by a predetermined distance, and the second gloss sensor 51, the image sensor 52, and the second light source 53 are disposed in this order from the upstream side in the direction along the conveyance direction of the sheet S.

Similarly to the first light source 42, the second light source 53 includes, for example, an LED, a laser oscillator, or the like, and is configured to irradiate the sheet S being conveyed with white light. In the present embodiment, the second light source 53 is disposed such that the incident angle of the irradiation light with respect to the surface of the sheet S is a predetermined angle (60 degrees in the present embodiment). In the present embodiment, since the specular light is detected by the second gloss sensor 51, light emitted from the second light source 53 preferably has a certain degree of directivity.

The image sensor 52 includes a light receiving element such as a CCD or a CMOS, and includes at least one pixel. In the present embodiment, the image sensor 52 includes, for example, a plurality of pixels including an R pixel, a G pixel, and a B pixel. In addition, the image sensor 52 may include, for example, an imaging element in which solid-state imaging elements are arranged in a two-dimensional array, or may include a linear sensor. The image sensor 52 is disposed at a position where diffuse reflection light emitted from the second light source 53 and diffusely reflected on the surface of the sheet S can be acquired. In the present embodiment, the image sensor 52 is disposed at a position where light emitted from the second light source 53 and diffusely reflected in a direction perpendicular to the sheet conveyance direction can be acquired.

In the image sensor 52, image information of the toner image fixed on the surface of the sheet S by the fixing unit 28 is acquired. In the present embodiment, based on the image information acquired by the image sensor 52, the color of toner or ink, the drawing area per unit area (BW ratio), and the drawing mass per unit area (toner adhesion amount) of the toner image formed on the sheet are detected by the detection condition setting unit 60 to be described later (see FIG. 3).

The second gloss sensor 51 includes a linear sensor in which light receiving elements such as CCDs or CMOSs are one-dimensionally arranged in a direction along the conveyance direction of the sheet S. The second gloss sensor 51 is disposed at a position where specular light emitted from the second light source 53 and reflected on the surface of the sheet S can be acquired. In the present embodiment, since light emitted from the second light source 53 is disposed such that the incident angle with respect to the surface of the sheet S is 60 degrees, the second gloss sensor 51 is disposed at a position where specular light having a reflection angle of 60 degrees can be acquired.

In the present embodiment, the light amount of the second light source 53 and/or the exposure time of the second gloss sensor 51 are/is set for each sheet on the basis of the paper type of the sheet to be detected by the detection condition setting unit 60 and the image information of the toner image formed on the sheet. A method for setting the light amount of the second light source 53 and/or the exposure time of the second gloss sensor 51 by the detection condition setting unit 60 will be described later.

In the present embodiment, the second gloss sensor 51 outputs a signal corresponding to the light amount of light specularly reflected by the sheet S. In this way, the second gloss sensor 51 can detect the diffusion distribution of light specularly reflected by the sheet S. In the present embodiment, the glossiness of the sheet S is detected by a glossiness detector 61 to be described later (see FIG. 3) in accordance with the diffusion distribution detected by the second gloss sensor 51.

The controller 6 includes, for example, a central processing unit (CPU), a read only memory (ROM), a random access memory (RAM), and a storage including, for example, a hard disc drive (HDD). The storage stores a program causing the CPU to control each unit, a print job received from an external terminal such as a computer, image data generated from the print job, image information acquired by the first sensor unit 40 and the second sensor unit 50, glossiness detection conditions, image forming conditions, and the like.

In addition, the controller 6 integrally controls each unit of the image forming system 1 by causing the CPU to read a predetermined processing program stored in the ROM or the storage, develop the predetermined processing program in the RAM, and execute the developed program. The control of each unit in the controller will be described in detail later.

[Sheet Ejection Unit]

The sheet ejection unit 4 includes a conveyance path switcher 30, a sheet ejection tray 32, and a sub-tray 31. The conveyance path switcher 30 switches the destination of the sheet being conveyed to a sheet conveyance path 10*a* side or a sheet conveyance path 10*b* side on the basis of an instruction from the controller 6. In this way, the sheet being conveyed is distributed and ejected to the sheet ejection tray 32 or the sub-tray 31.

2. Control Configuration of Image Forming System

Figure 3:
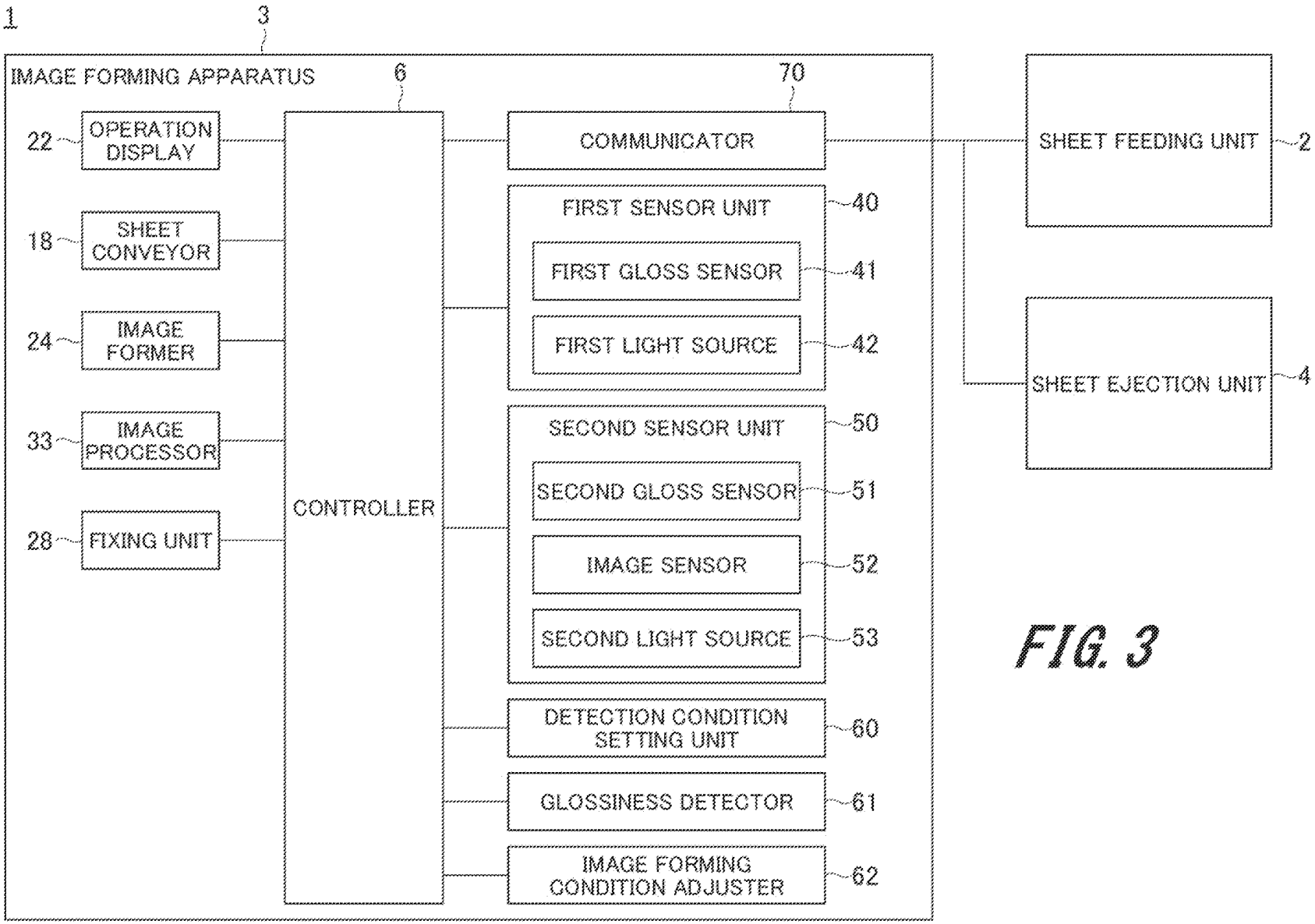
FIG. 3 is a block diagram illustrating a configuration example of a control system of an image forming system according to an embodiment of the present invention.

Next, a control configuration of the image forming system 1 according to the present embodiment will be described. FIG. 3 is a block diagram illustrating a configuration example of a control system of the image forming system 1 according to the present embodiment. As illustrated in FIG. 3, the image forming system 1 according to the present embodiment includes the sheet feeding unit 2, the image forming apparatus 3, and the sheet ejection unit 4, all of which have been described above.

In the image forming apparatus 3, each of the operation display 22, the sheet conveyor 18, the image former 24, the image processor 33, the fixing unit 28, the communicator 70, the first sensor unit 40, the second sensor unit 50, the detection condition setting unit 60, the glossiness detector 61, and the image forming condition adjuster 62 is connected to the controller 6. Each unit is controlled by the controller 6. The respective processing executed by the operation display 22, the sheet conveyor 18, the image former 24, the image processor 33, the fixing unit 28, the first sensor unit 40, and the second sensor unit 50 is as described above. Hereinafter, the communicator 70, the detection condition setting unit 60, the glossiness detector 61, and the image forming condition adjuster 62 will be described.

Under the control of the controller 6, the communicator 70 transmits and receives various data to and from a communicator (not illustrated) of each of the sheet feeding unit 2, the sheet ejection unit 4, and an external device (for example, a personal computer; not illustrated) via a network. The communicator 70 communicates with a communicator of each unit via a communication network such as a local area network (LAN) or a wide area network (WAN).

Under the control of the controller 6, the detection condition setting unit 60 identifies the paper type of the sheet to be inspected on the basis of the diffusion distribution of light detected by the first gloss sensor 41 of the first sensor unit 40. Then, the detection condition setting unit 60 sets the detection conditions of the second light source 53 and/or the second gloss sensor 51 at the time of glossiness detection on the basis of the identified paper type of the sheet and the image information detected by the image sensor 52 of the second sensor unit 50.

Figure 4:
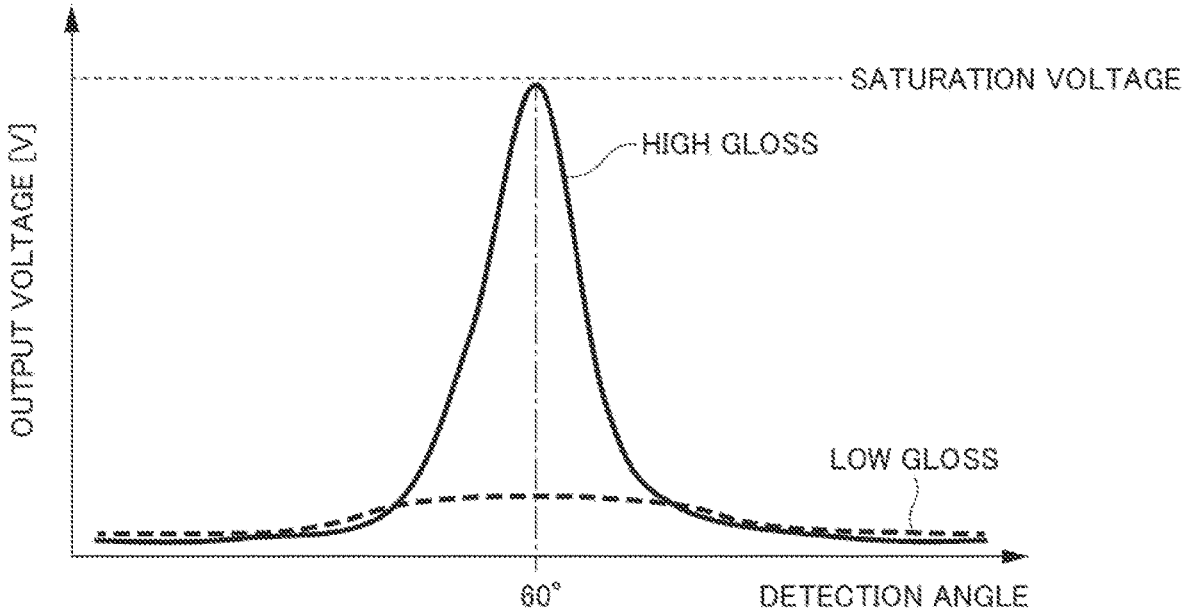
FIG. 4 is a graph indicating a diffusion distribution of light detected in low-gloss paper and high-gloss paper.

Here, the relationship between the diffusion distribution of light detected by the first gloss sensor 41 and the paper type will be described. FIG. 4 is a graph indicating a diffusion distribution of light detected in low-gloss paper and high-gloss paper.

FIG. 4 indicates a result of detecting a diffusion distribution of specular light in a sheet by a sensor device including a light source and a gloss sensor, which is configured similarly to the first sensor unit 40.

In FIG. 4, the horizontal axis represents a detection angle of specular light, and the vertical axis represents an output voltage output by the gloss sensor. In FIG. 4, the light amount of light emitted from the light source and the exposure time of the gloss sensor are constant at the time of detecting the diffusion distribution in low-gloss paper and at the time of detecting the diffusion distribution in high-gloss paper.

As indicated in FIG. 4, in the high-gloss paper, the output voltage output by the gloss sensor has a steep peak at or near a detection angle of 60 degrees. On the other hand, in the low-gloss paper, the output voltage output by the gloss sensor is low and exhibits little change with respect to the change in the detection angle.

Figure 5A:
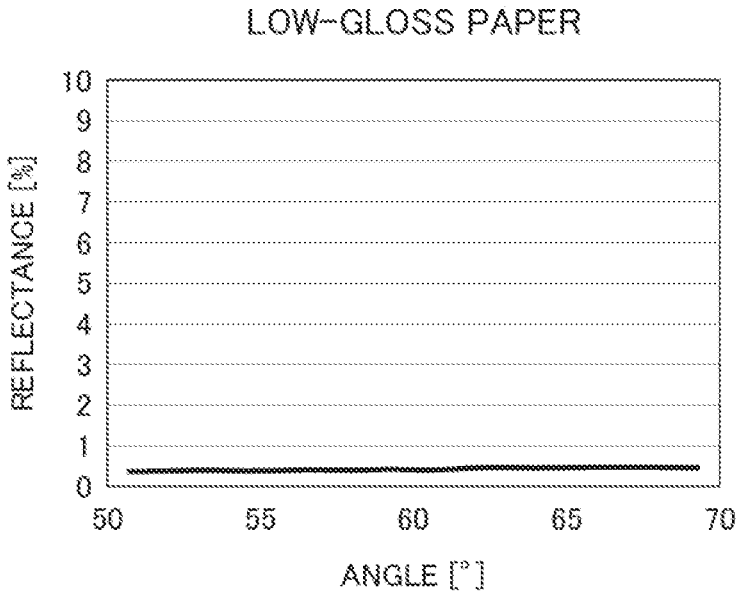
FIG. 5A is a graph in which a vertical axis in a diffusion distribution of low-gloss paper indicated in FIG. 4 is converted into reflectance.
Figure 5B:
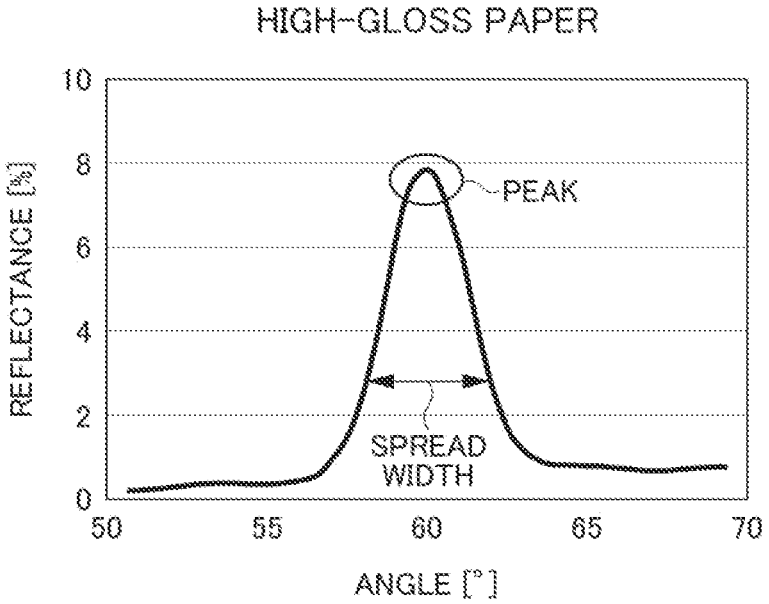
FIG. 5B is a graph in which a vertical axis in a diffusion distribution of high-gloss paper indicated in FIG. 4 is converted into reflectance.

FIG. 5A is a graph in which a vertical axis in a diffusion distribution of low-gloss paper illustrated in FIG. 4 is converted into reflectance. FIG. 5B is a graph in which a vertical axis in a diffusion distribution of high-gloss paper illustrated in FIG. 4 is converted into reflectance. Even when the output voltage is converted into the reflectance, the diffusion distribution indicates a similar tendency.

As described above, the gloss sensor can acquire the diffusion distribution of the sheet to be inspected. However, in a case where the light amount of light emitted from the light source and the exposure time of the gloss sensor are constant at the time of detecting the diffusion distribution in the low-gloss paper and at the time of detecting the diffusion distribution in the high-gloss paper, the output is low for the low-gloss paper. Thus, the accuracy is low as the detection of glossiness.

Figure 6:
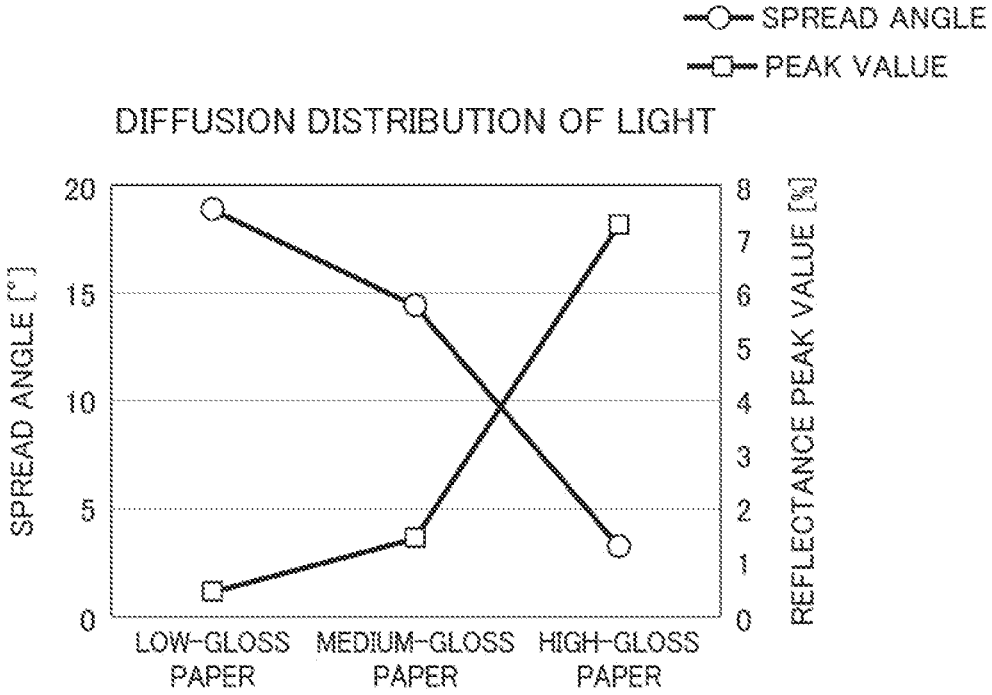
FIG. 6 is a graph of a diffusion distribution of light detected in various sheets, which is obtained by plotting a peak spread angle and a reflectance peak value.

On the other hand, as indicated in FIGS. 5A and 5B, the high-gloss paper has characteristics that the peak value is clear, the spread angle (width) is small, and the peak value of the sheet decreases and the spread angle increases as the gloss decreases. FIG. 6 is a graph of a diffusion distribution of light detected in various sheets, which is obtained by plotting a peak spread angle and a reflectance peak value. As indicated in FIG. 6, low-gloss paper such as plain paper has a low peak value and a large spread width. On the other hand, high-gloss paper such as cast coated paper has a large peak value and a small spread angle. Therefore, the paper type of the sheet can be identified using the diffusion distribution of light as indicated in FIG. 6.

In the present embodiment, the detection condition setting unit 60 identifies whether the sheet to be inspected is the high-gloss paper, the medium-gloss paper, or the low-gloss paper by using the diffusion distribution of light detected by the first gloss sensor 41, and identifies the paper type. Examples of the paper type identified here include plain paper, coated paper, embossed paper, and the like. As indicated in FIG. 6, the paper type may be identified based on the spread angle, or based on the spread angle and the reflectance peak value, for example.

Figure 7:
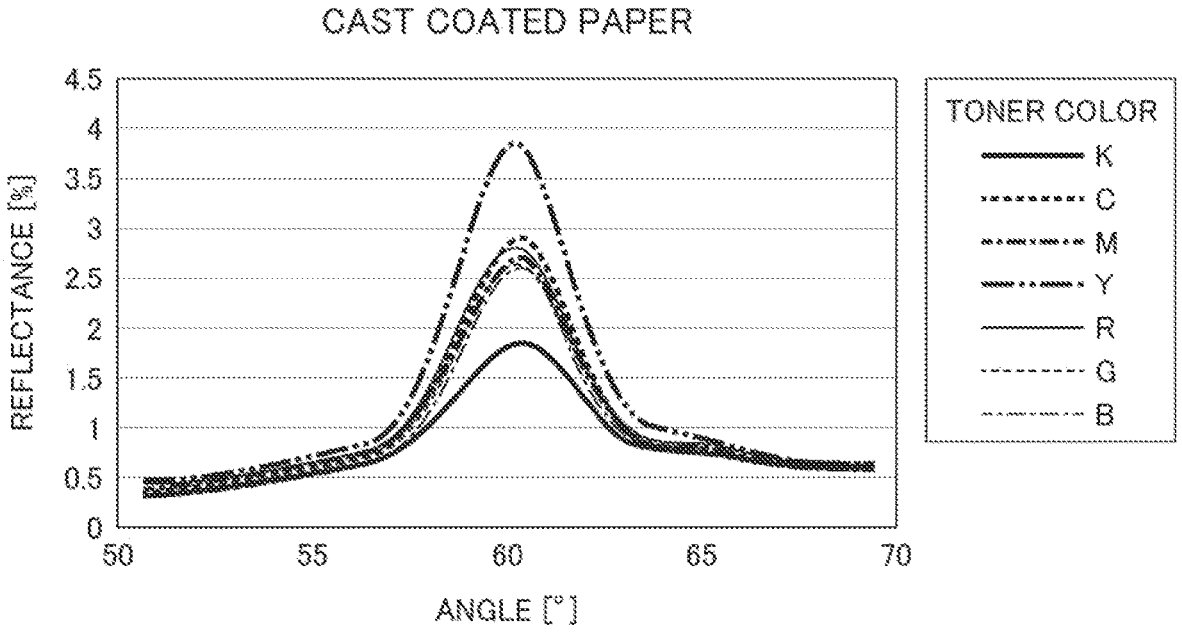
FIG. 7 is a graph indicating a difference in gloss distribution (diffusion distribution of light) due to a difference in toner color.
Figure 8:
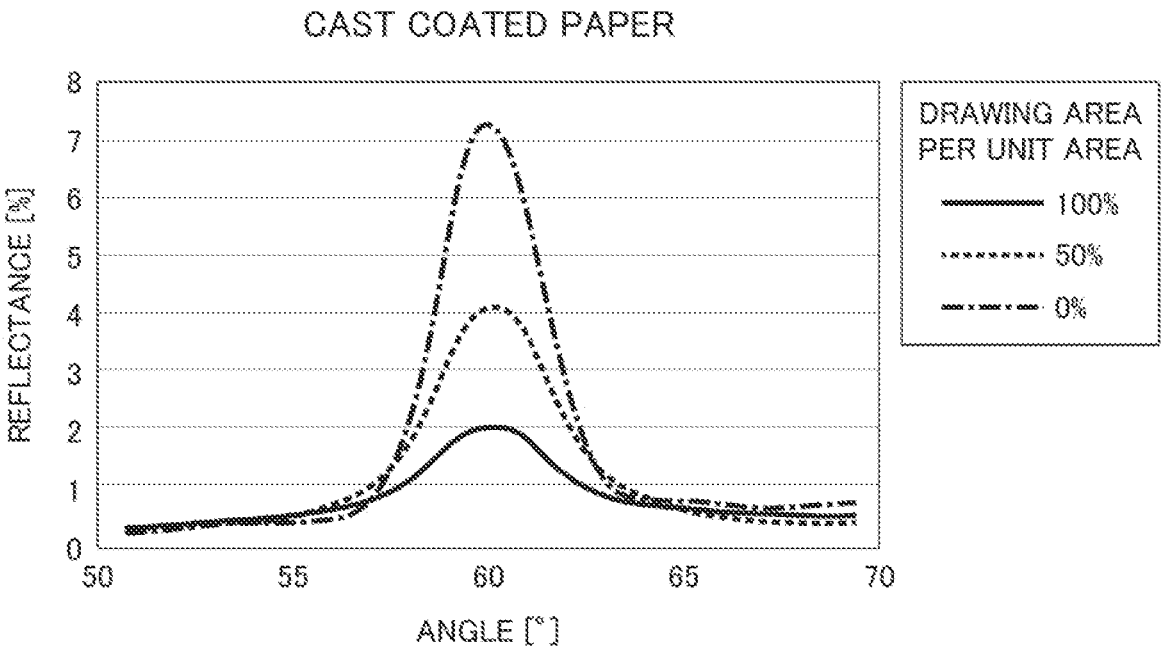
FIG. 8 is a graph indicating a difference in gloss distribution (diffusion distribution of light) due to a difference in drawing area per unit area (BW ratio)
Figure 9:
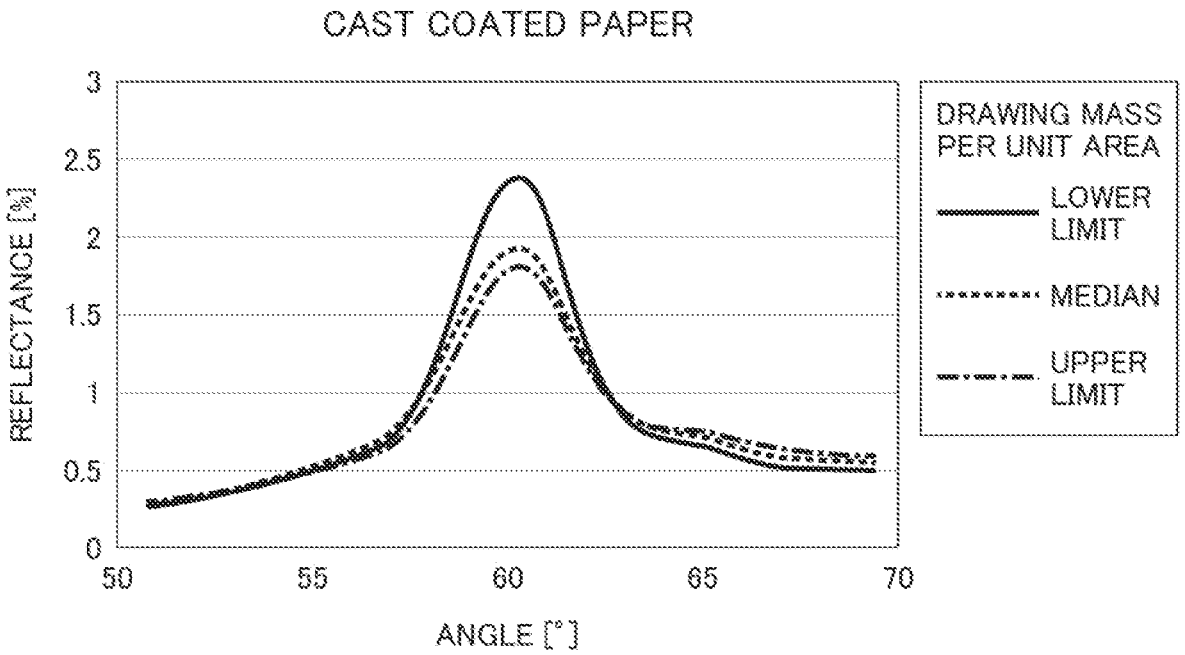
FIG. 9 is a graph indicating a difference in gloss distribution (diffusion distribution of light) due to a difference in drawing mass per unit area (toner adhesion amount)

Next, a relationship between a toner image formed on a sheet and glossiness will be described. FIG. 7 is a graph indicating a difference in gloss distribution (diffusion distribution of light) due to a difference in toner color. FIG. 8 is a graph indicating a difference in gloss distribution (diffusion distribution of light) due to a difference in drawing area per unit area (BW ratio). FIG. 9 is a graph indicating a difference in gloss distribution (diffusion distribution of light) due to a difference in drawing mass per unit area (toner adhesion amount). FIGS. 7 and 8 indicate detection results obtained by detecting the diffusion distribution of light in the sheet on which image is formed and after passing through the fixing unit 28 is detected by a sensor unit having the configuration similar to the second light source 53 and the second gloss sensor 51 illustrated in FIG. 3B. In FIGS. 7 and 8, cast coated paper is used as the sheet, and fixing conditions are identical to each other. In addition, in FIGS. 7 and 8, the light amount and the exposure time in the sensor unit are constant.

As indicated in FIG. 7, when the toner color is black (K), the reflectance is lower than that in the case where the toner color is yellow (Y). As indicated in FIG. 8, when the drawing area per unit area is large, the reflectance is lower than that in the case where the pattern area is small. As indicated in FIG. 9, when the toner adhesion amount is large, that is, when the mass of the toner per drawing area is large, the reflectance is lower than that in the case where the toner adhesion amount is small, that is, the case where the mass of the toner per drawing area is small. As described above, the glossiness of the sheet after image formation also varies depending on the toner color, the drawing area per unit area (BW ratio), and the drawing mass per unit area (toner adhesion amount).

Therefore, when the diffusion distribution of light on the sheet on which the toner image is drawn under such a condition that the reflectance is low is detected under the condition similar to the sheet on which the toner image is drawn under such a condition that the reflectance is high, there is a possibility that glossiness cannot be accurately detected.

In view of this, the present embodiment utilizes the above-described features. Specifically, the detection condition setting unit 60 detects at least one of the toner color, the BW ratio, and the toner adhesion amount from the image information detected from the image sensor 52, and adjusts the detection conditions of the diffusion distribution of light detected by the second gloss sensor 51 in accordance with the detected image information.

FIG. 10 is an example of a table indicating glossiness detection conditions in accordance with a paper type and image information. The table given in FIG. 10 associates each condition of the paper type and the image information with the exposure time and the light amount suitable for each condition, and is stored in the storage of the controller 6. The values of the exposure time of the second gloss sensor 51 and the light emission amount of the second light source 53 set in the table given in FIG. 10 are calculated in advance from experimental values or the like.

For example, the exposure time of the second gloss sensor 51 is set longer in a low-gloss sheet such as plain paper than in a high-gloss sheet such as coated paper. In addition, the light emission amount of the second light source 53 (indicated by the current amount in FIG. 10) is set higher in a low-gloss sheet such as plain paper than in a high-gloss sheet such as coated paper.

In the present embodiment, the detection condition setting unit 60 identifies the paper type from the diffusion distribution of light detected by the first gloss sensor 41, and detects the toner color, the BW ratio, and the toner adhesion amount from the image information detected by the image sensor 52. Then, the detection condition setting unit 60 sets the light amount of the second light source 53 and the exposure time of the second gloss sensor 51 at the time of glossiness detection by collating the detected conditions with a table indicating detection conditions stored in advance in the storage (see FIG. 10).

The glossiness detector 61 detects glossiness of the sheet on the basis of the diffusion distribution detected by the second gloss sensor 51. More specifically, the glossiness detector 61 detects glossiness of the sheet on the basis of the measurement result of the diffusion distribution detected by the second gloss sensor 51. For example, glossiness can be detected by referring to a table (not illustrated) in which the measurement result of the diffusion distribution detected by the second gloss sensor 51 and the detection conditions set by the detection condition setting unit 60 are associated with glossiness.

In the present embodiment, the light amount of the second light source 53 and the exposure time of the second gloss sensor 51 at the time of glossiness detection are appropriately set in accordance with the type (paper type) of the sheet to be inspected. Accordingly, it is possible to avoid a problem that accurate reflectance cannot be detected because the diffusion distribution of light is flat in a low-gloss sheet, for example. Thus, glossiness can be detected more accurately.

The image forming condition adjuster 62 adjusts the image forming condition (fixing condition) in accordance with the glossiness detected by the glossiness detector 61. Here, a difference in glossiness when fixing conditions are made different will be described.

Figure 11A:
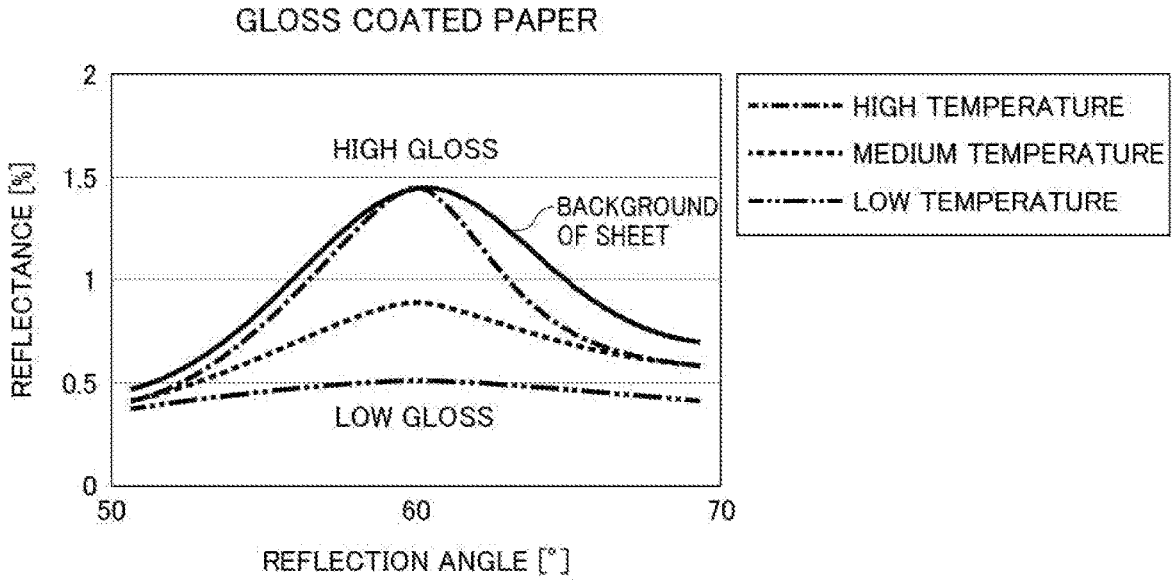
FIG. 11A indicates a measurement result obtained by measuring a diffusion distribution of light in gloss coated paper on which a toner image is formed and that has passed through a fixing unit.
Figure 11B:
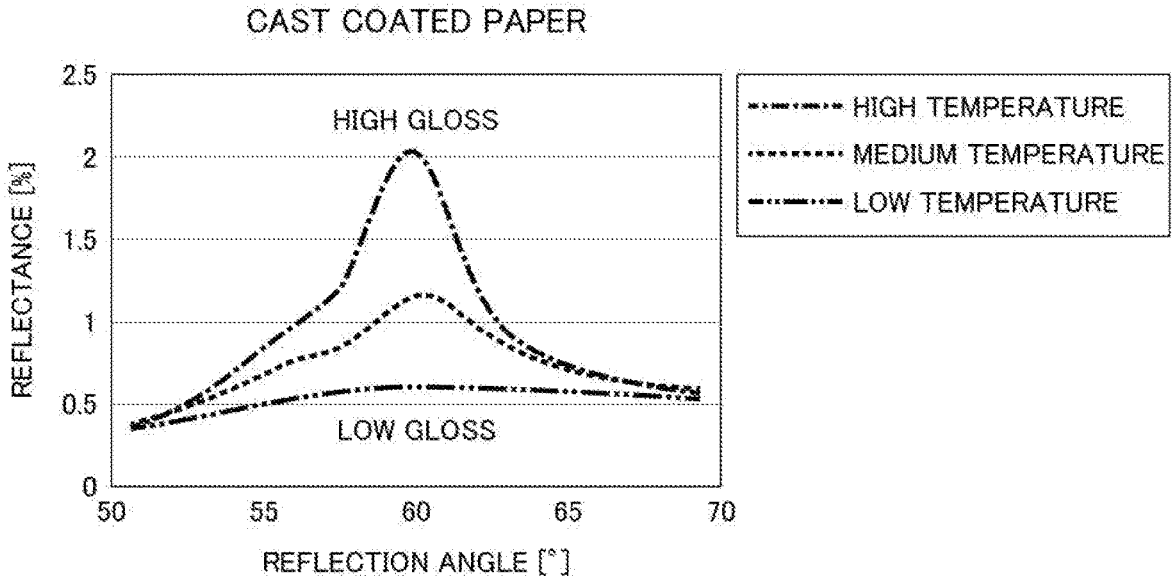
FIG. 11B indicates a measurement result obtained by measuring the diffusion distribution of light in the cast coated paper on which the toner image is formed and that has passed through the fixing unit.

FIG. 11A indicates a measurement result obtained by measuring a diffusion distribution of light in gloss coated paper on which a toner image is formed and that has passed through the fixing unit 28. FIG. 11B indicates a measurement result obtained by measuring the diffusion distribution of light in cast coated paper on which the toner image is formed and that has passed through the fixing unit 28. FIGS. 11A and 11B indicate detection results when the fixing temperature in the fixing unit 28 is changed to a low temperature, a medium temperature, and a high temperature. For comparison, FIG. 11A also indicates a detection result of a background of a sheet on which a toner image is not formed. The measurement results indicated in FIGS. 11A and 11B are measured by a sensor unit having the configuration similar to the second light source 53 and the second gloss sensor 51 included in the second sensor unit 50.

As indicated in FIGS. 11A and 11B, generally, high fixing temperature increases glossiness, and low fixing temperature decreases glossiness. Therefore, for example, when the glossiness detected by the second gloss sensor 51 is lower than the reference (target) glossiness, the image forming condition adjuster 62 adjusts the fixing temperature to be high. Conversely, when the glossiness detected by the second gloss sensor 51 is higher than the reference glossiness, the image forming condition adjuster 62 adjusts the fixing temperature to be low. Thus, a printed matter having a target glossiness can be obtained. In addition, glossiness can also be adjusted by changing the nip width of the fixing unit 28 and the conveyance speed.

As described above, in the present embodiment, the image forming condition adjuster 62 compares the preset reference (target) glossiness with the glossiness detected by the glossiness detector 61. Then, based on the difference thereof, the image forming condition adjuster 62 adjusts the fixing condition such that the glossiness of the sheet after passing through the fixing unit 28 has the reference glossiness. Information about the reference glossiness and the fixing condition according to the change rate of glossiness is stored in advance in the storage. The image forming condition adjuster 62 adjusts the fixing condition by using the information stored in the storage under the control of the controller 6.

3. Method for Detecting Glossiness

Figure 12:
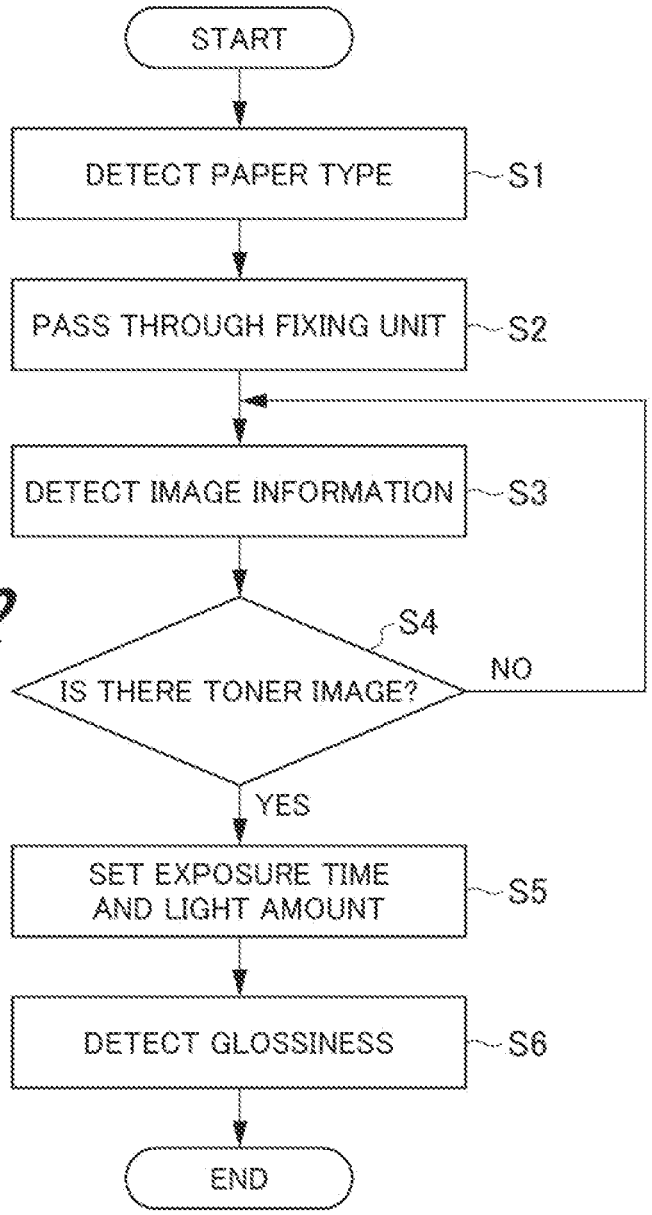
FIG. 12 is a flowchart illustrating an example of a method for detecting glossiness using an image forming system according to an embodiment of the present invention.

Next, an example of a method of detecting glossiness according to the present embodiment will be described. FIG. 12 is a flowchart illustrating an example of a method for detecting glossiness using the image forming system 1 according to the present embodiment. As illustrated in FIG. 12, at first, the detection condition setting unit 60 determines the paper type of the sheet fed from the sheet feeding unit 2 (step S1). In step S1, first, the first gloss sensor 41 detects the diffusion distribution of light in the sheet at the timing when the sheet fed from the sheet feeding unit 2 passes through the arrangement position of the first sensor unit 40. Thereafter, the detection condition setting unit 60 identifies the paper type of the sheet on the basis of the detected diffusion distribution of light.

Next, the sheet passes through the fixing unit 28 (step S2). Through this step, when the toner image has been transferred onto the sheet by the transfer unit (secondary transfer roller 27), the transferred toner image is fixed to the sheet. In step S2, the fixing unit 28 is controlled by the controller 6 on the basis of a preset fixing condition.

Next, the image sensor 52 detects image information of a toner image formed on the sheet at the timing when the sheet passes through the arrangement position of the second sensor unit 50 (step S3).

Then, the detection condition setting unit 60 determines whether a toner image is formed on the sheet (step S4). When it is determined as "NO" in step S4, that is, when it is determined that no toner image is formed, the process returns to step S3.

On the other hand, when it is determined as "YES" in step S4, that is, when it is determined that a toner image is formed, the detection condition setting unit 60 sets the detection conditions of the second sensor unit 50 at the time of glossiness detection on the basis of the image information of the toner image and the paper type identified in step S1. The detection conditions set in step S5 is the light amount of the second light source 53 and the exposure time of the second gloss sensor 51 in the second sensor unit 50.

Thereafter, the glossiness of the sheet on which the toner image is formed is detected on the basis of the diffusion distribution of light detected by the second gloss sensor 51 (step S6). In step S6, first, the diffusion distribution of light in the sheet is detected by the second gloss sensor 51 on the basis of the detection conditions set in step S5. Then, glossiness is detected by the glossiness detector 61 based on the diffusion distribution of light detected by the second gloss sensor 51.

As described above, in the present embodiment, glossiness can be accurately detected by appropriately setting the light amount of the second light source 53 and the exposure time of the second gloss sensor 51 at the time of glossiness detection on the basis of the paper type and the image information of the toner image formed on the sheet.

In the present embodiment, when the glossiness of the sheet detected on the basis of the diffusion distribution detected by the second gloss sensor 51 is greatly different from the glossiness estimated in advance from the paper type and the image information, the processes of steps S1 to S6 may be repeated again. In this case, for example, a value stored in advance in the storage of the controller 6 can be used as the estimation value of the glossiness estimated from the paper type and the image information. In this way, the detection accuracy of the glossiness of the sheet on which the toner image is formed can be enhanced, and more accurate glossiness can be detected.

In the present embodiment, the glossiness of the sheet on which the toner image is formed can be accurately detected, making it possible to further setting the fixing condition appropriately by the image forming condition adjuster 62. In this way, the glossiness of the sheet on which the toner image is formed can be set to be a desired glossiness, and the reproducibility of the image formed on the sheet can be improved.

In the present embodiment, the light amount of the second light source 53 and the exposure time of the second gloss sensor 51 are set (changed) on the basis of the paper type and the image information of the toner image formed on the sheet. However, any one of the light amount of the second light source 53 and the exposure time of the second gloss sensor 51 may be adjusted.

In the present embodiment, the paper type is identified on the basis of the diffusion distribution of light detected by the first gloss sensor 41 of the first sensor unit 40, but the present invention is not limited thereto. For example, the paper type may be identified on the basis of information transmitted from the sheet feeding unit 2 via the communicator 70, or may be identified from information stored in the storage of the image forming apparatus 3. Furthermore, after the sheet passes through the fixing unit 28, specular light reflected from a leading end portion of the sheet where printing is not applied to may be detected by the second gloss sensor 51, and the paper type may be identified from the detection result. In this case, the paper type is identified using the diffusion distribution of light detected by the second gloss sensor 51, and then the light amount of the second light source 53 and/or the exposure time of the second gloss sensor 51 at the time of glossiness detection are/is set in accordance with the identified paper type. As a result, it is possible to detect the glossiness of the portion of the sheet where the image is formed after fixing.

When the paper type cannot be identified using specular light reflected from the leading end of the sheet because printing is applied to the leading end portion of the sheet, a sheet on which no toner image is formed is conveyed as the first sheet, and the paper type is identified on the conveyed sheet. Then, the light amount of the second light source 53 and/or the exposure time of the second gloss sensor 51 at the time of glossiness detection are/is set in accordance with the identified paper type. Thereafter, the glossiness of the sheet on which the toner image is formed may be detected on the second sheet.

In the present embodiment, the image information of the toner image formed on the sheet is detected by the image sensor 52 of the second sensor unit 50, but information stored in the storage may be used as the image information. By using the information stored in the storage, the processing of setting the light amount of the second light source 53 and/or the exposure time of the second gloss sensor 51 can be performed before the sheet reaches the second sensor unit 50. As a result, at the time of glossiness detection, the timing accuracy of detecting the diffusion distribution of light in the second gloss sensor 51 can be improved, and the glossiness of the sheet can be detected in real time.

In the present embodiment, in order to detect the glossiness of the sheet on which the toner image is formed, the glossiness of the sheet that has passed through the fixing unit 28 is detected, but the present invention is not limited thereto. The configuration of the present invention can be used to accurately detect glossiness of a sheet on which no toner image is formed.

When the glossiness of the sheet on which no toner image is formed is detected, the detection condition setting unit 60 identifies the paper type of the sheet to be inspected on the basis of, for example, information stored in advance in the storage or information transmitted from the sheet feeding unit 2 via the communicator 70. Next, the detection condition setting unit 60 sets the light amount of the first light source 42 in the first sensor unit 40 and/or the exposure time of the first gloss sensor 41 in accordance with the identified paper type. Thereafter, the first sensor unit 40 detects the diffusion distribution of light in the sheet being conveyed. Then, the glossiness detector 61 detects the glossiness of the sheet on the basis of the diffusion distribution of light detected by the first gloss sensor 41 and the detection conditions. In this manner, it is also possible to detect glossiness of a sheet on which no toner image is formed.

In addition, when the glossiness of the sheet on which no toner image is formed is detected on the basis of the diffusion distribution of light detected by the first sensor unit 40, the paper type can be identified before the glossiness detection from the diffusion distribution of light detected by the first sensor unit 40.

In this case, the first gloss sensor 41 detects the diffusion distribution of light in the leading end portion of the conveyed sheet, and the detection condition setting unit 60 identifies the paper type on the basis of the detected diffusion distribution. Thereafter, the detection condition setting unit 60 sets the light amount of the first light source 42 and/or the exposure time of the first gloss sensor 41 at the time of glossiness detection in accordance with the identified paper type. Then, the first gloss sensor 41 again detects the diffusion distribution of light in the conveyed sheet under the set detection conditions. Subsequently, the glossiness detector 61 detects glossiness on the basis of the diffusion distribution detected under the conditions set by the detection condition setting unit 60. In this manner, the first gloss sensor 41 sequentially performs the detection of the diffusion distribution of light for identifying the paper type of the sheet being conveyed and the detection of the diffusion distribution of light for detecting glossiness, whereby the glossiness of the sheet on which no toner image is formed can be accurately detected.

In the present embodiment, the first sensor unit 40 is disposed in the image forming apparatus 3, but may be disposed in a pre-processing apparatus disposed on the upstream side of the image forming apparatus 3 in the sheet conveyance direction, such as the sheet feeding unit 2. Furthermore, in the present embodiment, the second sensor unit 50 is disposed in the image forming apparatus 3, but may be disposed in a post-processing apparatus provided on the downstream side of the image forming apparatus 3 in the sheet conveyance direction, such as the sheet ejection unit 4.

In addition, in the present embodiment, the glossiness on the front surface side of the sheet being conveyed is detected. However, when toner images are formed on both sides of the sheet, the glossiness on the back surface side may be detected.

The above-described embodiments have been described in detail for ease of understanding of the present invention, and the present invention is not necessarily limited to those having all the described configurations. For example, a part of the configuration of each embodiment can be replaced with another configuration, and another configuration can be added to the configuration of each embodiment. Addition, deletion, and replacement of another configuration can be made with respect to a part of the configuration of each embodiment.

Although embodiments of the present invention have been described and illustrated in detail, the disclosed embodiments are made for purposes of illustration and example only and not limitation. The scope of the present invention should be interpreted by terms of the appended claims.

DESCRIPTION OF REFERENCE NUMERALS

1 . . . image forming system
2 . . . sheet feeding unit
3 . . . image forming apparatus
4 . . . sheet ejection unit
6 . . . controller
10 . . . sheet conveyance path
12 . . . conveyance roller
14 . . . registration unit
18 . . . sheet conveyor
21 . . . image reader
22 . . . operation display
23 . . . sheet feeding tray
24 . . . image former

25 . . . intermediate transfer belt
27 . . . secondary transfer roller
28 . . . fixing unit
30 . . . conveyance path switcher
33 . . . image processor
40 . . . first sensor unit
41 . . . first gloss sensor
42 . . . first light source
50 . . . second sensor unit
51 . . . second gloss sensor
52 . . . image sensor
53 . . . second light source
60 . . . detection condition setting unit
61 . . . glossiness detector
62 . . . image forming condition adjuster
70 . . . communicator

The invention claimed is:

1. An image forming system comprising:

a sensor unit including a light source that irradiates a medium being conveyed with light, and a gloss sensor that receives light emitted from the light source and specularly reflected on the medium, and detects a diffusion distribution of light in the medium;

a detection condition setting unit that identifies a type of the medium being conveyed and sets a light amount of the light source and/or exposure time of the gloss sensor at time of glossiness detection in accordance with the type of the medium; and a glossiness detector that detects glossiness of the medium from the diffusion distribution of light detected by the gloss sensor under a detection condition set by the detection condition setting unit.

2. The image forming system according to claim 1, further comprising:

a transfer unit that transfers a toner image onto the medium; and a fixing unit that fixes, to the medium, the toner image transferred to the medium by the transfer unit, wherein the sensor unit is disposed on a downstream side of the fixing unit in a conveyance direction of the medium.

3. The image forming system according to claim 2, further comprising an other sensor unit including an other light source that irradiates the medium being conveyed with light, and an other gloss sensor that receives light emitted from the other light source and specularly reflected on the medium, and detects a diffusion distribution of light in the medium, wherein the other sensor unit is disposed on an upstream side of the transfer unit in the conveyance direction of the medium, and the detection condition setting unit identifies a type of the medium on a basis of the diffusion distribution of light detected by the other gloss sensor.

4. The image forming system according to claim 2, wherein the detection condition setting unit identifies a type of the medium on a basis of a diffusion distribution of light in a portion where the toner image of the medium detected by the gloss sensor is not formed.

5. The image forming system according to claim 2, wherein the sensor unit includes an image sensor that receives light diffusely reflected on the medium and detects image information of the toner image formed on the medium, and the detection condition setting unit sets the light amount of the light source and/or the exposure time of the gloss sensor at the time of glossiness detection on a basis of the identified type of the medium and the image information detected by the image sensor.

6. The image forming system according to claim 5, wherein the image information detected by the image sensor includes at least any one of a toner color, a drawing area per unit area, and a drawing mass per unit area.

7. The image forming system according to claim 2, further comprising a storage that stores image information of the toner image to be formed on the medium, wherein the detection condition setting unit sets the light amount of the light source and/or the exposure time of the gloss sensor at the time of glossiness detection on a basis of the identified type of the medium and the image information stored in the storage.

8. The image forming system according to claim 1, wherein, in the detection condition setting unit, the type of the medium is identified by a peak value or a spread width in the diffusion distribution of light detected by the gloss sensor.

9. The image forming system according to claim 1, further comprising:

a transfer unit that transfers a toner image onto the medium; and a fixing unit that fixes, to the medium, the toner image transferred to the medium by the transfer unit, wherein the sensor unit is disposed on an upstream side of the fixing unit in a conveyance direction of the medium, and the type of the medium is identified on a basis of the diffusion distribution of light detected by the gloss sensor.

10. The image forming system according to claim 1, further comprising a storage that stores a type of the medium, wherein the type of the medium being conveyed is identified from the information stored in the storage.

11. The image forming system according to claim 1, wherein the gloss sensor includes a plurality of light receiving elements arranged one-dimensionally or two-dimensionally.

12. A method for detecting glossiness, the method using a sensor unit including a light source that irradiates a medium being conveyed with light, and a gloss sensor that receives light emitted from the light source and specularly reflected on the medium and detects a diffusion distribution of light in the medium, the method comprising:

identifying a type of the medium being conveyed, and setting a light amount of the light source and/or exposure time of the gloss sensor at time of glossiness detection in accordance with the type of the medium; and detecting a diffusion distribution of light in the medium by the gloss sensor by using the set light amount and/or the set exposure time, and then detecting glossiness of the medium from the detected diffusion distribution of light.

* * * * *